US011380245B2

(12) United States Patent
Gu et al.

(10) Patent No.: US 11,380,245 B2
(45) Date of Patent: Jul. 5, 2022

(54) DISPLAY DRIVE METHOD, DISPLAY DRIVE APPARATUS, DISPLAY APPARATUS, AND WEARABLE DEVICE

(71) Applicants: Beijing BOE Optoelectronics Technology Co., Ltd., Beijing (CN); BOE TECHNOLOGY GROUP CO., LTD., Beijing (CN)

(72) Inventors: Qibing Gu, Beijing (CN); Hsinchung Lo, Beijing (CN); Chen Meng, Beijing (CN); Rui Liu, Beijing (CN); Wei Sun, Beijing (CN); Guangquan Wang, Beijing (CN); Ming Chen, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 47 days.

(21) Appl. No.: 16/438,994

(22) Filed: Jun. 12, 2019

(65) Prior Publication Data

US 2020/0074916 A1 Mar. 5, 2020

(30) Foreign Application Priority Data

Aug. 28, 2018 (CN) ..... 201810989261.9

(51) Int. Cl.
*G09G 3/20* (2006.01)

(52) U.S. Cl.
CPC ..... *G09G 3/2096* (2013.01); *G09G 3/2003* (2013.01); *G09G 2310/0202* (2013.01);
(Continued)

(58) Field of Classification Search
CPC .. G09G 3/2096; G09G 3/2003; G09G 3/3688; G09G 3/3413; G09G 3/3275;
(Continued)

(56) References Cited

U.S. PATENT DOCUMENTS 5,682,175 A * 10/1997 Kitamura ..... G09G 3/20 345/98
6,128,045 A * 10/2000 Anai ..... H04N 7/0122 348/556
(Continued)

FOREIGN PATENT DOCUMENTS

CN 1383536 A 12/2002
CN 1652170 A 8/2005
(Continued)

OTHER PUBLICATIONS

First Office Action for CN Patent Application No. 201810989261.9 dated Jan. 6, 2021.

*Primary Examiner* — Fred Tzeng
(74) *Attorney, Agent, or Firm* — Thomas | Horstemeyer LLP

(57) ABSTRACT

The present disclosure discloses a display drive method, a display drive apparatus, a display apparatus, and a wearable device. The display drive method includes: receiving an original display data signal; sampling the original display data signal based on a clock input signal to obtain a display mode signal, a gate line scanning signal, and an initial data voltage signal; shifting the initial data voltage signal according to the display mode signal to obtain a data voltage signal; and controlling the display apparatus to display based on the display mode signal, the gate line scanning signal, and the data voltage signal.

14 Claims, 12 Drawing Sheets

(52) U.S. Cl.
CPC ..... *G09G 2310/0243* (2013.01); *G09G 2310/0267* (2013.01); *G09G 2310/0286* (2013.01); *G09G 2310/08* (2013.01)

(58) Field of Classification Search
CPC .. G09G 3/3233; G09G 3/3648; G09G 3/3266; G09G 3/20
USPC ..... 345/213
See application file for complete search history.

(56) References Cited

U.S. PATENT DOCUMENTS 6,788,277 B2 * 9/2004 Kanauchi ..... G09G 3/3266 315/169.2
2001/0022573 A1 * 9/2001 Sasaki ..... G09G 3/3688 345/100
2002/0135556 A1 * 9/2002 Nakajima ..... G09G 3/3688 345/98
2003/0038795 A1 * 2/2003 Uchino ..... G09G 3/3648 345/213
2005/0206604 A1 * 9/2005 Washio ..... G09G 3/3688 345/98
2005/0206637 A1 * 9/2005 Takahashi ..... G09G 3/3688 345/204
2006/0284816 A1 * 12/2006 Jang ..... G09G 3/3688 345/98
2007/0063959 A1 * 3/2007 Iwabuchi ..... G09G 3/3688 345/100
2007/0091053 A1 * 4/2007 Kajiwara ..... G09G 3/3688 345/100
2008/0001861 A1 * 1/2008 Asano ..... G09G 3/3233 345/77
2008/0094343 A1 * 4/2008 Osame ..... G09G 3/3275 345/99
2010/0146175 A1 * 6/2010 Choe ..... G09G 3/3688 710/110
2012/0056870 A1 * 3/2012 Koh ..... G09G 3/20 345/215
2015/0177321 A1 * 6/2015 Gherman ..... G01R 31/318541 714/729
2019/0108798 A1 * 4/2019 Ishihara ..... G09G 3/3413

FOREIGN PATENT DOCUMENTS

CN 102237054 A 11/2011
CN 103969872 A 8/2014
CN 104933983 A 9/2015

* cited by examiner

DISPLAY DRIVE METHOD, DISPLAY DRIVE APPARATUS, DISPLAY APPARATUS, AND WEARABLE DEVICE

CROSS-REFERENCE TO RELATED APPLICATION

This application is based upon, claims the benefit of, and claims priority to Chinese Patent Application No. 201810989261.9, filed on Aug. 28, 2018, the entire contents thereof being incorporated herein by reference.

TECHNICAL FIELD

The present disclosure relates to the field of display technologies and, more particularly, to a display drive method, a display drive apparatus, a display apparatus, and a wearable device.

BACKGROUND

Wearable products may include, for example, smart watches, smart wristbands, virtual reality glasses, and so forth, which may be directly worn on the human body.

The wearable products usually have a display function, and can display information such as texts or images. The existing wearable products need to be provided with drive chips which are used for providing, to the wearable products, drive signals required for display, for example, gate line scanning signals and data signals, etc.

Different types of wearable products require different types of drive chips, which increases the development cycles and costs of the products.

SUMMARY

The present disclosure provides a display drive method, a display drive apparatus, a display apparatus, and a wearable device.

According to a first aspect of embodiments of the present disclosure, there is provided a display drive method, which includes:

receiving an original display data signal;

sampling the original display data signal based on a clock input signal to obtain a display mode signal, a gate line scanning signal, and an initial data voltage signal;

shifting the initial data voltage signal according to the display mode signal to obtain a data voltage signal; and controlling the display apparatus to display based on the display mode signal, the gate line scanning signal, and the data voltage signal.

Optionally, the sampling of the original display data signal based on the clock input signal to obtain the display mode signal, the gate line scanning signal, and the initial data voltage signal includes:

counting the number of pulses in the clock input signal, and acquiring a display mode data bit, a gate line scanning data bit, and a data voltage data bit from the original display data signal, respectively, according to the number of pulses counted;

obtaining the display mode signal based on the display mode data bit;

decoding the gate line scanning data bit to obtain the gate line scanning signal; and obtaining the initial data voltage signal according to the data voltage data bit.

Optionally, the shifting of the initial data voltage signal according to the display mode signal to obtain the data voltage signal includes:

shifting the initial data voltage signal according to the number of bits of a data voltage in the display mode signal to obtain the data voltage signal.

Optionally, the obtaining of the display mode signal based on the display mode data bit includes:

determining a current display state mode and a color display state mode for the display apparatus based on a value of each data bit of the display mode data bit; and generating a corresponding display mode signal according to the current display state mode and the color display state mode.

Optionally, the display state mode includes: a no update mode, an all-clear mode, a normal display mode, and a display blinking mode.

The color display state mode includes: a black-and-white display state mode and a color display state mode.

Optionally, the counting the number of pulses in the clock input signal, and acquiring a display mode data bit, a gate line scanning data bit, and a data voltage data bit from the original display data signal respectively according to the number of pulses counted;

counting the number of pulses in the clock input signal by using a first counter to obtain a first number, a second number and a third number respectively;

acquiring the display mode data bit from the original display data signal according to the first number;

acquiring the gate line scanning data bit from the original display data signal according to the second number; and acquiring the data voltage data bit from the original display data signal according to the third number.

Optionally, the method also includes: latching the data voltage signal after the data voltage signal is received, and writing the latched data voltage signal into a pixel unit of the display apparatus after the gate line scanning signal of a current row is received;

outputting the gate line scanning signal of a next row after writing the data voltage signal is completed;

starting to count using a second counter when latching the data voltage signal, and stopping counting after writing the data voltage signal is completed; and controlling the first counter not to output a signal when the second counter is not zero, and resetting the first counter when the second counter stops counting.

According to a second aspect of the embodiments of the present disclosure, there is provided a display drive apparatus, which includes:

a display data signal receiving circuit configured to receive an original display data signal;

a signal sampling circuit configured to sample the original display data signal based on a clock input signal to obtain a display mode signal, a gate line scanning signal, and an initial data voltage signal;

a data shifting circuit configured to shift the initial data voltage signal according to the display mode signal to obtain a data voltage signal; and a display circuit configured to control the display apparatus to display based on the display mode signal, the gate line scanning signal, and the data voltage signal.

Optionally, the display data signal receiving circuit is a serial peripheral interface.

Optionally, the signal sampling circuit includes:

a first counter configured to count the number of pulses in the clock input signal, and acquire a display mode data bit, a gate line scanning data bit and a data voltage data bit from the original display data signal, respectively, according to the number of pulses counted;

a display mode determining circuit configured to obtain the display mode signal based on the display mode data bit;

a gate line decoder configured to decode the gate line scanning data bit to obtain the gate line scanning signal; and a decoder configured to obtain the initial data voltage signal according to the data voltage data bit.

Optionally, the data shifting circuit includes:

a data bit determining circuit configured to determine the number of bits of a data voltage in the display mode signal; and a shift register configured to shift the initial data voltage signal according to the number of bits of the data voltage to obtain the data voltage signal.

Optionally, the apparatus also includes: a data latch configured to latch the data voltage signal after the data voltage signal is received, and write the latched data voltage signal into a pixel unit of the display apparatus after the gate line scanning signal of a current row is received;

a gate line scanning signal control circuit configured to output the gate line scanning signal of a next row after writing the data voltage signal is completed;

a second counter configured to start to count when latching the data voltage signal, and stop counting after writing the data voltage signal is completed; and a first counter control circuit configured to control the first counter not to output a signal when the second counter is not zero, and reset the first counter when the second counter stops counting.

According to a third aspect of the embodiments of the present disclosure, there is provided a display apparatus, which includes: a display panel and the display drive apparatus described above, wherein the display drive apparatus is arranged on the display panel.

According to a fourth aspect of the embodiments of the present disclosure, there is provided a wearable device, which includes the display apparatus described above.

It is understood that both the foregoing general description and the following detailed description are exemplary and explanatory only and are not restrictive of the present disclosure.

BRIEF DESCRIPTION OF THE DRAWINGS

The accompanying drawings herein are incorporated in and constitute a part of this specification, and illustrate embodiments conforming to the present disclosure and, together with the description, serve to explain the principles of the present disclosure.

DETAILED DESCRIPTION

Reference will now be made in detail to exemplary embodiments, examples of which are illustrated in the accompanying drawings. When accompanying figures are mentioned in the following descriptions, the same numbers in different drawings represent the same or similar elements, unless otherwise represented. The implementations set forth in the following description of exemplary embodiments do not represent all implementations consistent with the present disclosure. Instead, they are merely examples of apparatus and methods consistent with aspects related to the disclosure as recited in the appended claims.

Figure 1:
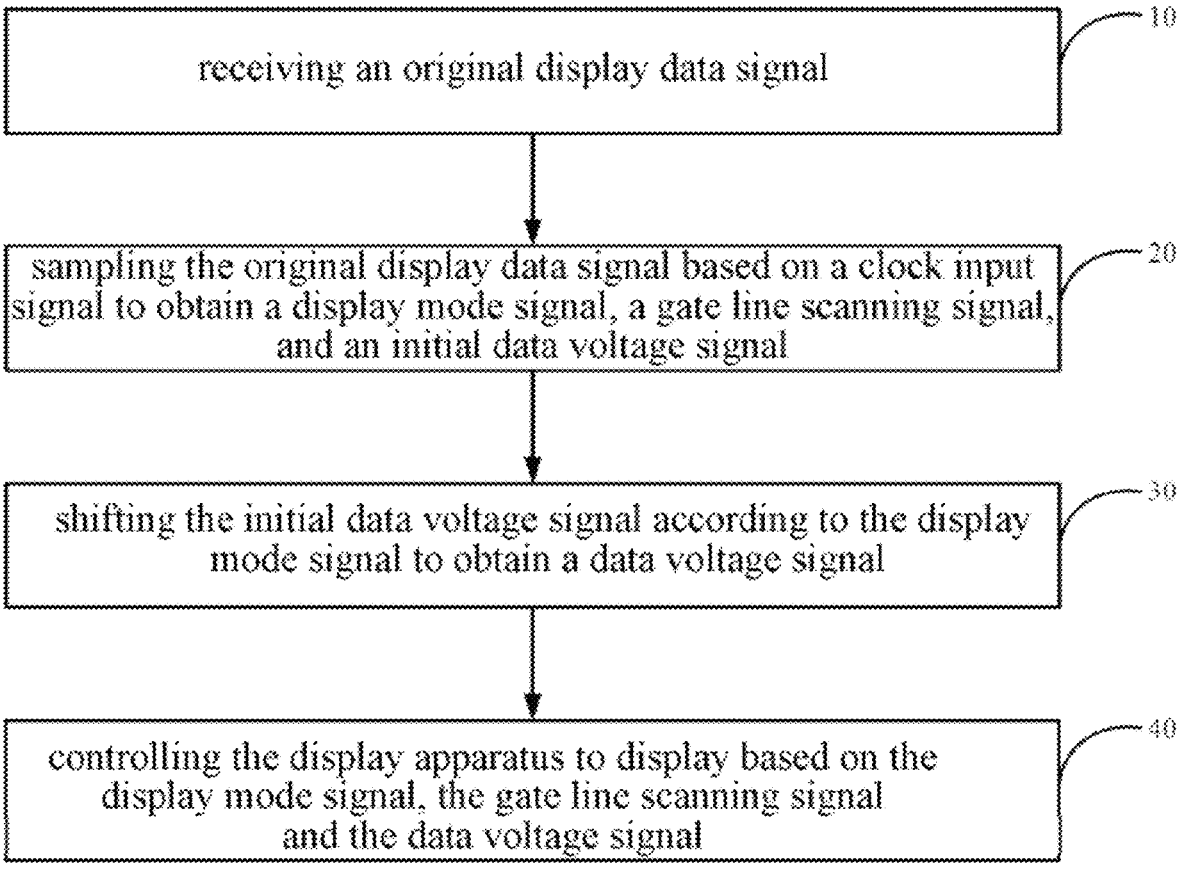
FIG. 1 illustrates a flowchart of a display drive method according to an exemplary embodiment of the present disclosure.

An embodiment of the present disclosure provides a display drive method, which is applied to a display apparatus. As shown in FIG. 1, the method includes:

Step S10: receiving an original display data signal;

Step S20: sampling the original display data signal based on a clock input signal to obtain a display mode signal, a gate line scanning signal, and an initial data voltage signal;

Step S30: shifting the initial data voltage signal according to the display mode signal to obtain a data voltage signal; and Step S40: controlling the display apparatus to display based on the display mode signal, the gate line scanning signal, and the data voltage signal.

The original display data signal is a relevant data signal required for display by the display apparatus. The display data signal may be a digital signal in binary form, and may include a plurality of data bits. Each of the data bits may be binary, a 0 or 1. Signals having different contents may be represented by a plurality of data bits in different locations among the plurality of data bits.

As a signal including a plurality of data bits is transmitted based on a certain cycle, the original display data signal is not sampled. The original display data signal may be generated by a microcontroller unit (MCU) in the display apparatus. The MCU may transmit, via a corresponding interface, the generated original display data signal to a relevant driving circuit of the display apparatus, such that the driving circuit generates, according to the received original display data signal, drive signals provided to a gate line, a data line, a pixel circuit, and the like in the display apparatus. The display apparatus displays according to these drive signals.

The MCU may transmit the generated original display data signal to a driving circuit of the display apparatus via, for example, a serial peripheral interface (SPI), which is a synchronous serial peripheral interface allowing the MCU to communicate with various peripheral devices in a serial manner to exchange information. The SPI interface on the MCU may be coupled to the driving circuit and other related components (such as an A/D converter and a network controller) in the display apparatus via an SPI bus.

The received original display data signal is further sampled according to the clock input signal to obtain a display mode signal, a gate line scanning signal, and an initial data voltage signal. That is, the various signals required are separated from the original display data signal.

The display mode signal is a signal indicating a display mode of the display apparatus. The display apparatus may have various display modes, for example, a black-and-white display mode, a color display mode, a white display mode, a black display mode, etc.

The display apparatus includes a display panel composed of an array substrate and a color filter substrate. The display panel has a plurality of pixel units arranged in a matrix. The array substrate is provided with a plurality of gate lines and a plurality of data lines, and extension directions of the gate lines are different from those of the data lines. For example, the gate lines are distributed along a lateral direction of the array substrate, whereas the data lines are distributed along a longitudinal direction of the array substrate. Regions obtained by intersecting the gate lines with the data lines are defined as the pixel units. Each of the pixel units includes a pixel electrode and a thin film transistor. A gate of the thin film transistor is coupled to the gate line in the corresponding row, a source of the thin film transistor is coupled to the data line, and a drain of the thin film transistor is coupled to the pixel electrode. A switch signal is provided to the gate of the thin film transistor through the gate line to control on or off of the thin film transistor. A data voltage is supplied to the source of the thin film transistor through the data line. When the thin film transistor is turned on, the data voltage is supplied to the pixel electrode through the thin film transistor to charge the pixel electrode, thereby controlling a display grayscale of each pixel unit to display.

The gate line scanning signal is a scan control signal supplied to each row of gate lines in the display apparatus. The scanning signal is used to control on or off of the thin film transistor coupled to each row of gate lines. The initial data voltage signal is a data voltage signal supplied to each column of data lines of the display apparatus. The data voltage signal is used to provide a charging pixel voltage to the pixel electrode to control the display grayscale of the pixel unit. A magnitude of the data voltage signal directly decides the display grayscale of the pixel unit. The magnitude of the data voltage signal is set according to the display grayscale of each pixel unit.

The initial data voltage signal may indicate the magnitude of the voltage supplied to each column of data lines. However, when the display apparatus finally displays, the data voltage signal is also related to the display mode of the display apparatus. Therefore, the initial data voltage signal needs to be shifted according to the display mode signal to obtain the data voltage signal finally supplied to each column of data lines.

The display apparatus displays according to the display mode signal, the gate line scanning signal, and the data voltage signal.

As can be seen from the description above, according to the display drive method, the display mode signal, the gate line scanning signal, and the data voltage signal required for display may be obtained by sampling the original display data signal. Then, the display apparatus may correspondingly display according to the display mode. Corresponding signals may be generated according to different types of display apparatuses. This display drive method is applicable to different types of display apparatuses, and is particularly applicable to wearable products. Therefore, this display drive method is universal, which is advantageous in reducing product development cycles and development costs.

Figure 2:
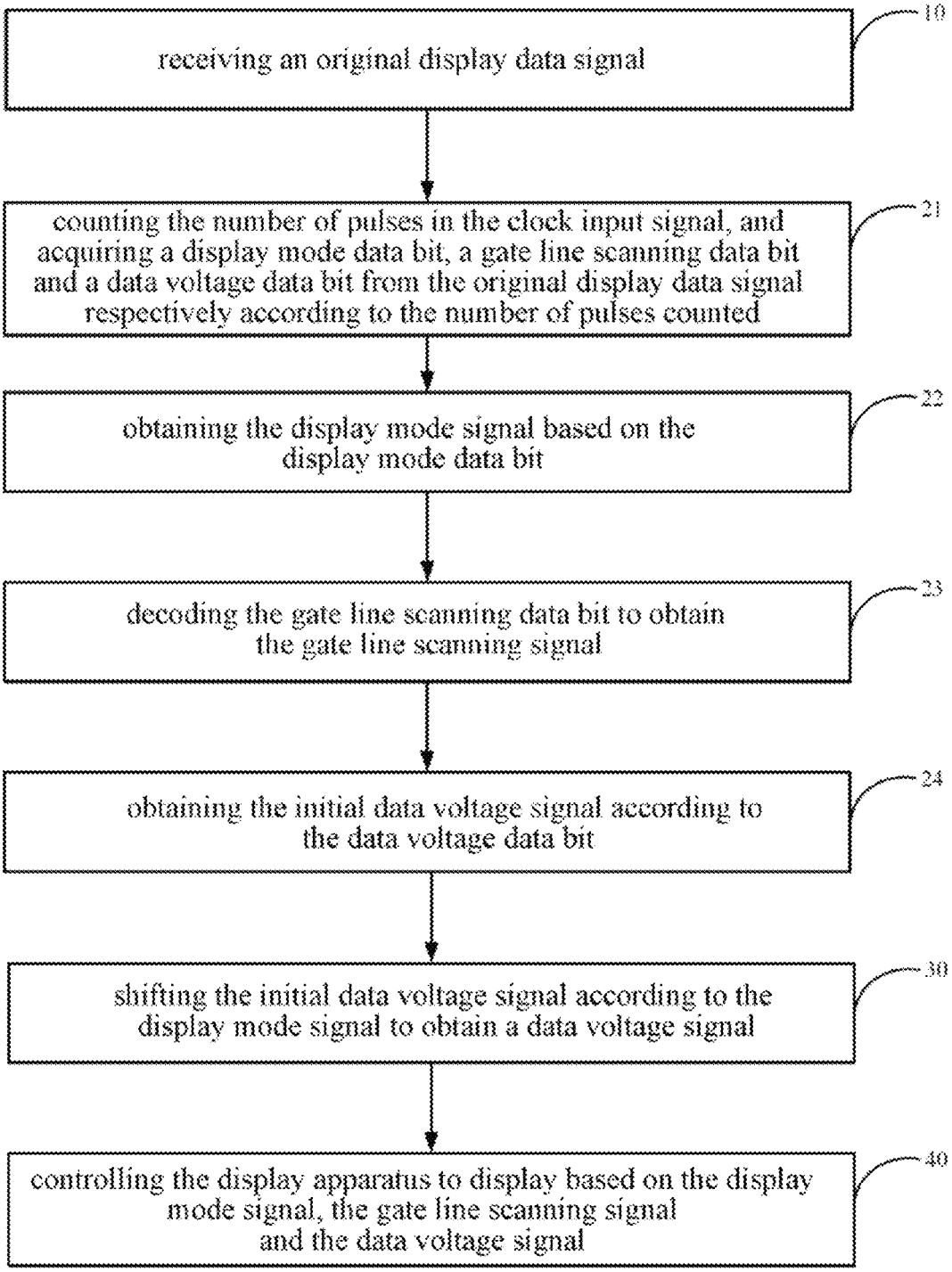
FIG. 2 illustrates a flowchart of a display drive method according to another exemplary embodiment of the present disclosure.

In an optional embodiment, as shown in FIG. 2, the Step S20 of sampling the original display data signal based on a clock input signal to obtain a display mode signal, a gate line scanning signal, and an initial data voltage signal includes:

Step S21: counting the number of pulses in the clock input signal, and acquiring a display mode data bit, a gate line scanning data bit, and a data voltage data bit from the original display data signal respectively according to the number of pulses counted;

Step S22: obtaining the display mode signal based on the display mode data bit;

Step S23: decoding the gate line scanning data bit to obtain the gate line scanning signal; and Step S24: obtaining the initial data voltage signal according to the data voltage data bit.

The clock input signal is typically a pulse signal, the pulse signal including a plurality of continuous pulses. The original display data signal includes a plurality of data bits, among which several data bits are used to represent the display mode data bits, several data bits are used to represent the gate line scanning data bits, and several data bits are used to represent the data voltage data bits. The original display data signal typically has a certain format based on a communication protocol of an interface receiving the signal. Through parsing according to the communication protocol, the corresponding display mode data bits, gate line scanning data bits, and display mode data bits may be obtained.

The original display data signal transmits each of the data bits according to the clock input signal. Typically, one pulse in one clock input signal corresponds to one data bit, and by counting the number of pulses, a plurality of data bits corresponding to a plurality of pulses may be obtained. For example, for six data bits corresponding to the first pulse to the seventh pulse in the clock input signal, a 6 bit display mode data bit may be obtained. For ten data bits corresponding to the eighth pulse to the seventeenth pulse, a 10 bit gate line scanning data bit may be obtained. For a plurality of data bits corresponding to the eighteenth pulse to the nth pulse, an (n−17) bit data voltage data bit may be obtained.

The obtained display mode data bit is a binary digital signal, and may include a plurality of data bits. To further obtain the display mode signal, the value (for example, 0 or 1) of each data bit in the display mode data bit may be further determined to obtain a display mode signal, which is, for example, an input signal supplied to a relevant circuit in the display apparatus.

The gate line scanning signal may be obtained by decoding the gate line scanning data bit. The display apparatus typically includes a plurality of gate lines, and the gate line scanning data bit includes data of a plurality of bits. The gate line scanning signal corresponding to each gate line may be obtained by decoding the data of the plurality of bits.

The initial data voltage signal may be obtained by parsing the obtained data voltage data bit.

In some examples, the Step S21 may include:

Step S211: counting the number of pulses in the clock input signal by using a counter to obtain a first number, a second number, and a third number, respectively;

Step S212: acquiring the display mode data bit from the original display data signal according to the first number;

Step S213: acquiring the gate line scanning data bit from the original display data signal according to the second number; and Step S214: acquiring the data voltage data bit from the original display data signal according to the third number.

In this embodiment, the first number, the second number, and the third number are obtained respectively by counting the number of pulses in the clock input signal using the counter, thereby respectively acquiring the display mode data bit, the gate line scanning data bit, and the data voltage data bit.

Figure 3:
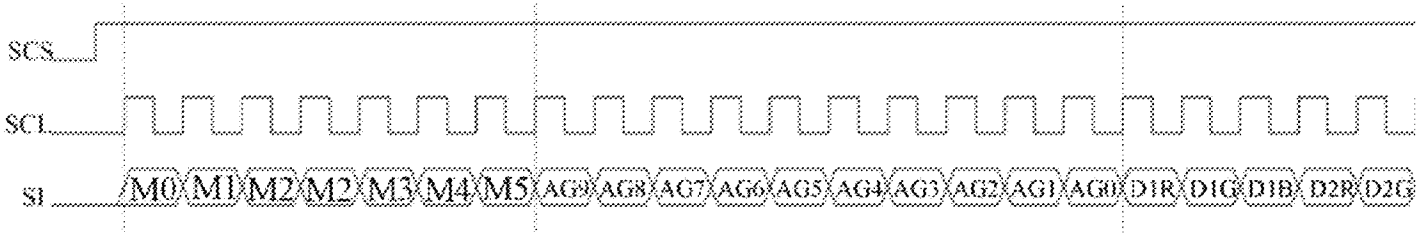
FIG. 3 illustrates a timing diagram of a signal outputted by a microcontroller unit (MCU) via its serial peripheral interface (SPI) according to an exemplary embodiment of the present disclosure.

For example, FIG. 3 shows a signal outputted by the MCU via its SPI interface. This signal is a signal based on an SPI communication protocol format, and this signal includes a synchronization signal (SCS), a clock input signal (clock signal input), and an original display data signal (SI).

Taking an example where the display apparatus includes 176 rows of gate lines and 44*12 columns of data lines and the original display data signal is a signal based on an SPI communication protocol format, the format of the original display data signal is, for example, as shown in the Table 1 below.

TABLE 1

| Mode | Gate Address | Data RGB | DUM | Gate Address | Data RGB | ... |
|---|---|---|---|---|---|---|
| 6 bit | 10 bit | 12 bit | 6 bit | 10 bit | 12 bit | ... |

As can be seen from the above Table 1, the original display data signal includes a display mode (Mode) data bit, a gate line scanning (Gate Address) data bit, and a data voltage data bit. The display mode data bit is represented by 6 bit data, the gate line scanning data bit is represented by 10 bit data, and the data voltage data bit is represented by 44*12 bit data.

It is to be noted that, the Table 1 only shows a part of the data voltage data bits, which may include a plurality of sets of data bits positioned at different locations. Furthermore, the original display data signal may include other data bits, for example, redundant (DUM) data bits, etc.

Referring to FIG. 3, the clock input signal SCL is a pulse signal including a plurality of continuous pulses. The number of the pulses is counted by a counter. Starting from the first pulse of the clock input signal SCL, the counter counts 1. When the counter counts the seventh pulse, 6 bit data between the first pulse and the seventh pulse are acquired, i.e., M0-M5 represent the display mode data bits. The counter continues counting, and when the counter counts the seventeenth pulse, 10 bit data between the eighth pulse and the seventeenth pulse are acquired, i.e., AG9-AG0 represent the gate line scanning data bits. The counter continues counting, and when the counter counts 12 pulses (only a part of the pulses are shown in the figure), 12 bit data between the seventeenth pulse and the 29th pulse are acquired, i.e., D1R, D1G, D1B, D2R, D2G, D2B, D3R, D3G, D3B and so on represent data voltage data bits.

It is to be noted that the above data voltage data bits include data voltages of a red (R) sub-pixel, green (G) sub-pixel and blue (B) sub-pixel included in each pixel unit that can display a colored screen. For example, D1R represents the data voltage of the red sub-pixel in the first column, D1G represents the data voltage of the green sub-pixel in the first column, D1B represents the data voltage of the blue sub-pixel in the second column, and so on. In this regard, the data voltages inputted to each column of sub-pixels in each pixel unit through each column of data lines may be obtained.

If the display apparatus displays black and white screens, the voltage of each pixel unit may only include two types of data voltages, i.e., the data voltage for displaying black by the pixel unit, and the data voltage for displaying white by the pixel unit.

In an optional embodiment, the Step S22 of obtaining the display mode signal based on the display mode data bit includes:

Step S221: determining a current display state mode and a color display state mode for the display apparatus based on a value of each data bit of the display mode data bit; and Step S222: generating a corresponding display mode signal according to the current display state mode and the color display state mode.

The display state mode includes, for example, a no update mode, an all-clear mode, a normal display mode, a display blinking mode, etc. The color display state mode includes, for example, a black-and-white display state mode and a color display state mode.

The display mode data bit represents a binary digital signal, and a plurality of data bits may be included. The value (for example, 0 or 1) of each data bit of the display mode data bits may be further determined to determine the display mode of the display apparatus, and then the display mode signal is obtained. For example, the display mode data bits include M0-M5, and the display mode may be determined based on the values of several data bits of the 6 data bits, and the values of the other data bits have no adverse effect on the determination result of the display mode.

For example, a variety of display modes may be determined based on the values of several data bits among the plurality of data bits. When the values of the data bits are the values as shown in the following Table 2, this indicates that the display mode at this moment is the no update mode, that is, the current display is a static display, and thus no update is required. At this moment, the value of the data bit M0 is L, which represents a low level, and may be expressed as the binary value 0; and the value of the data bit M2 is H, which represents a high level, and may be expressed as the binary value 1. For this display mode, it is only required to determine the values of the data bits M0 and M2, and the values of the other data bits M1, M3, M4, and M5 may be L or H.

TABLE 2

| M0 | M1 | M2 | M3 | M4 | M5 |
|---|---|---|---|---|---|
| L | L/H | H | L/H | L/H | L/H |

When the values of the data bits are the values as shown in the following Table 3, this indicates that the display mode at this moment is the all-clear mode, that is, the current display screen is cleared and is not displayed any more. At this moment, the value of the data bit M0 is L, which may be expressed as the binary value 0; the value of the data bit M2 is L, which may be expressed as the binary value 0; the value of the data bit M3 is H, which may be expressed as the binary value 1; and the value of the data bit M5 is L, which may be expressed as the binary value 0. For determination of this display mode, the values of the data bits M1 and M4 may be L or H.

TABLE 3

| M0 | M1 | M2 | M3 | M4 | M5 |
|---|---|---|---|---|---|
| L | L/H | L | H | L/H | L |

When the values of the data bits are the values as shown in the following Table 4, this indicates that the display mode at this moment is the normal display mode, i.e., screens are displayed normally. At this moment, the value of the data bit M0 is L, which may be expressed as the binary value 0; the value of the data bit M2 is L, which may be expressed as the binary value 0; and the value of the data bit M3 is L, which may be expressed as the binary value 0. For determination of this display mode, the values of the data bits M1, M4, and M5 may be L or H.

TABLE 4

| M0 | M1 | M2 | M3 | M4 | M5 |
|---|---|---|---|---|---|
| L | L/H | L | L | L/H | L/H |

When the values of the data bits are the values as shown in the following tables, this indicates that the display mode at this moment is the display blinking mode. That is, the display screen may be switched in a variety of ways as below: by way of inserting a black screen, by way of inserting a white screen, and by way of inserting a colored screen in a certain format.

For different switching modes, the values of the data bits are different. For example, when switching by way of inserting a black screen, the values of the data bits are the values as shown in the following Table 5. At this moment, the value of the data bit M0 is L, which may be expressed as the binary value 0; the value of the data bit M2 is L, which may be expressed as the binary value 0; the value of the data bit M3 is H, which may be expressed as the binary value 1; and the value of the data bit M4 is L, which may be expressed as the binary value 0.

TABLE 5

| M0 | M1 | M2 | M3 | M4 | M5 |
|---|---|---|---|---|---|
| L | L/H | L | H | L | L/H |

When switching by way of inserting a white screen, the values of the data bits are the values as shown in the following Table 6. At this moment, the value of the data bit M0 is L, which may be expressed as the binary value 0; the value of the data bit M2 is L, which may be expressed as the binary value 0; the value of the data bit M3 is H, which may be expressed as the binary value 1; and the value of the data bit M4 is H, which may be expressed as the binary value 1.

TABLE 6

| M0 | M1 | M2 | M3 | M4 | M5 |
|---|---|---|---|---|---|
| L | L/H | L | H | H | L/H |

When switching by way of inserting a colored screen, the values of the data bits are the values as shown in the following Table 7. At this moment, the value of the data bit M0 is L, which may be expressed as the binary value 0; the value of the data bit M2 is L, which may be expressed as the binary value 0; the value of the data bit M3 is H, which may be expressed as the binary value 1; and the value of the data bit M5 is H, which may be expressed as the binary value 1.

TABLE 7

| M0 | M1 | M2 | M3 | M4 | M5 |
|---|---|---|---|---|---|
| L | L/H | L | H | L/H | H |

The above display modes (referred to as display state modes herein) may be determined based on the values of several data bits among the display mode data bits. In addition, a display mode (referred to as a color display state mode herein) of a color (i.e., a color that can be displayed by each pixel unit when the display apparatus displays, for example, a colored screen or a black-and-white screen) that can be displayed may be determined based on the values of several data bits.

Therefore, the display state mode may be classified into two types according to the color of the display screen: one is a color display state mode, and the other is a black-and-white display state mode. Specifically, it may be further determined to which color display state mode the display state mode belongs according to several data bits among the display mode data bits. Furthermore, there are two cases for the colored display state mode, i.e., a data voltage includes 3 bit data, and a data voltage includes 4 bit data. To further distinguish the two cases described above, the color display state mode is further classified into a first color display state mode and a second color display state mode.

Referring to the values of the data bits in the following Table 8, for example, it may be determined to which color display state mode the display state mode belongs based on the values of the data bits M3 and M4 among the display mode data bits. If the value of the data bit M3 is L, which may be expressed as the binary value 0, and the value of the data bit M4 is L, which may be expressed as the binary value 0, the data voltage includes 3 bit data, and the display mode is the first color display state mode. If the value of the data bit M3 is L, which may be expressed as the binary value 0, and the value of the data bit M4 is H, which may be expressed as the binary value 1, the data voltage includes 1 bit data, and the display mode is the black-and-white display state mode. If the value of the data bit M3 is H, which may be expressed as the binary value 1, the data voltage includes 4 bit data, and the display mode is the second color display state mode. For those data bits whose values are not marked in the table, this indicates that the values of these data bits have no negative effect on the final determination of the display modes.

TABLE 8

| Mode | M3 | M4 | M5 |
|---|---|---|---|
| 3bit date | L | L | — |
| 1bit date | L | H | — |
| 4bit date | H | — | — |

The above determination of the display state modes and the determination of the color display state modes may be concurrent. That is, it may be simultaneously determined that the display mode includes one of the display state modes and one of the color display state modes.

Figure 4:
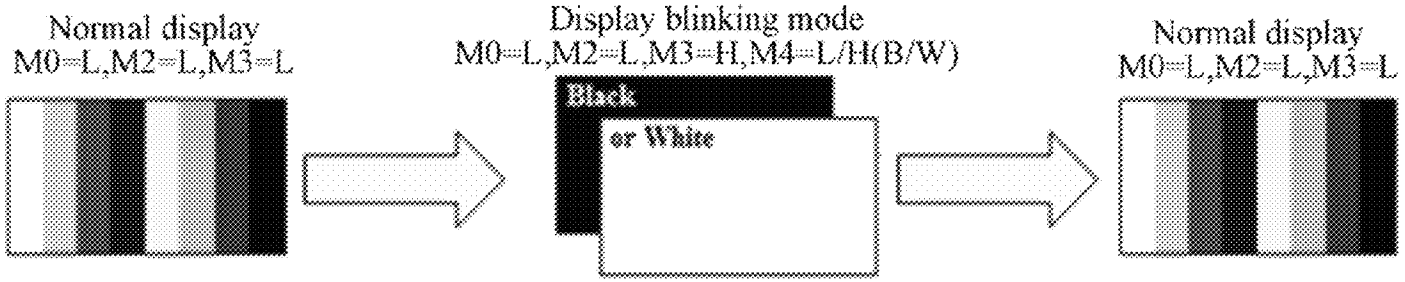
FIG. 4 illustrates a schematic diagram of pictures displayed by a display apparatus in different display modes according to an exemplary embodiment of the present disclosure.

Referring to FIG. 4, FIG. 4 is a schematic diagram schematically illustrating that the color display state mode is the first color display state mode and that the display state mode is switched between the normal display mode and a display blinking mode by way of inserting a black screen or a white screen. The displayed screen is a colored screen, and each pixel unit may display four or even more colors. At this moment, the data voltage signal has a variety of different grayscale voltages corresponding to the displayed colors.

Figure 5:
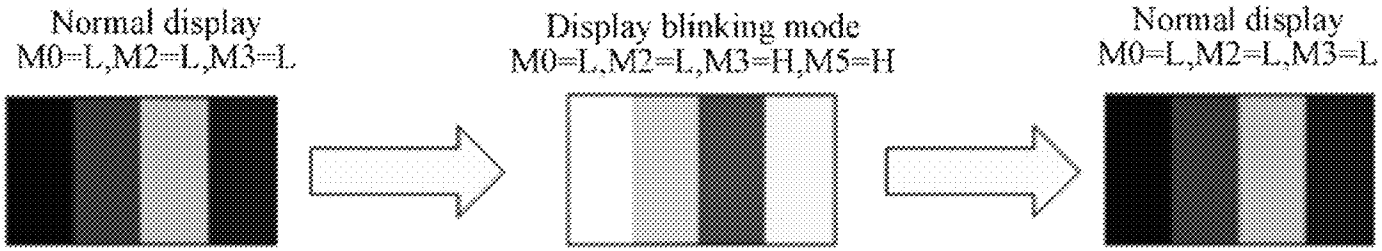
FIG. 5 illustrates a schematic diagram of pictures displayed by the display apparatus in different display modes according to another exemplary embodiment of the present disclosure.

Referring to FIG. 5, FIG. 5 is a schematic diagram schematically illustrating that the color display state mode is the second color display state mode and that the display state mode is switched between the normal display mode and a display blinking mode by way of inserting a colored screen. The displayed screen is a colored screen. Different from the colored screen shown in FIG. 4, each pixel unit in this colored screen may display four colors. At this moment, the number of the grayscale voltages included in the data voltage signal is smaller than the number of displayed screens shown in FIG. 4.

A logic circuit composed of gate circuits may be employed to determine a display mode based on the value of each data bit, and the logic circuit may output a corresponding display mode signal when the display mode is determined.

Figure 6:
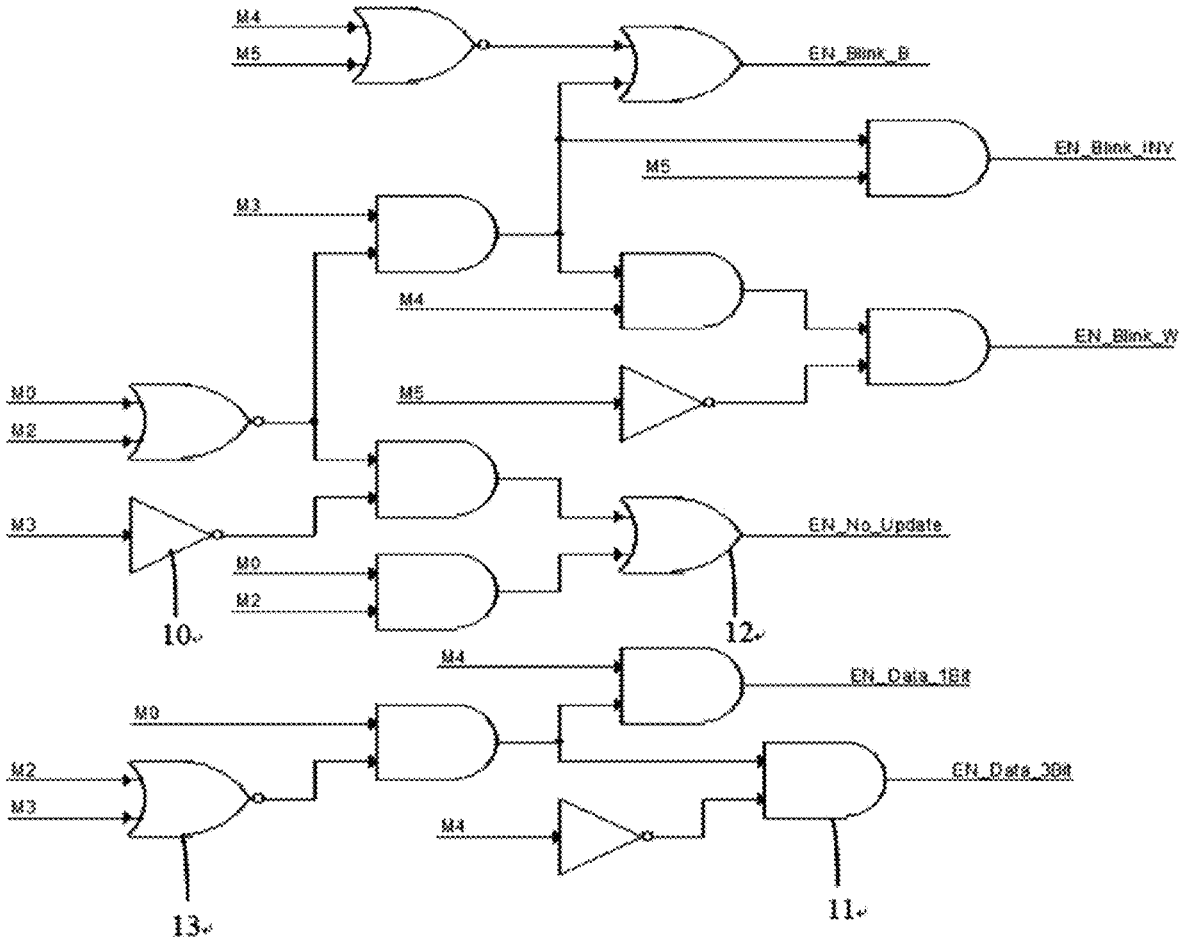
FIG. 6 illustrates a schematic structural diagram of a first logic circuit according to an exemplary embodiment of the present disclosure.

When the display mode data bit is 6 bit data, the logic circuit as shown in FIG. 6 may be employed, which is referred to as a first logic circuit herein. As a logic circuit composed of three inverters 10, nine AND gates 11, two OR gates 12 and two NOR gates 13, the first logic circuit includes a plurality of input terminals and a plurality of output terminals. Each data bit may be inputted to the corresponding input terminal. After being subjected to a logical operation by the first logic circuit, the data bit may be outputted, through the output terminal, as a determination result of the display mode. The output of the display terminal may be provided, as the display mode signal, to the corresponding driving circuit in the display apparatus.

Referring to FIG. 6, each data bit may be respectively inputted to the corresponding input terminal of the first logic circuit. For example, the data bits M0-M5 are respectively inputted to respective input terminals, and the output of the output terminal may represent the display mode signals. If values of the data bits inputted to the input terminals are different, the display mode signals outputted from the output terminals are also different. Therefore, the display mode signals may be obtained by the first logic circuit.

Specifically, the display mode signals obtained by performing a logic operation on each data bit by the first logic circuit are as below.

When the display state mode is the no update mode, the outputted display mode signal is referred to as a first state mode signal EN_No_Update:

$$EN_No_Update=/M0*/M2*/M3+M0*M2=/(M0+M2)*/M3+M0*M2.$$

When the display state mode is the display blinking mode by way of inserting a black screen, the outputted display mode signal is referred to as a second state signal EN_Blink_B:

$$EN_Blink_B=/M0*/M2*M3*/M4*/M5=/(M0+M2)*M3+/(M4+M5).$$

When the display state mode is a display blinking mode by way of inserting a white screen, the outputted display mode signal is referred to as a third state signal EN_Blink_W:

$$EN_Blink_W=/M0*/M2*M3*M4*/M5=/(M0+M2)*M3*M4*/M5.$$

When the display state mode is a display blinking mode by way of inserting a colored screen, the outputted display mode signal is referred to as a fourth state signal EN_Blink_INV:

$$EN_Blink_INV=/M0*/M2*M3*M5=/(M0+M2)*M3*M5.$$

Figure 7:
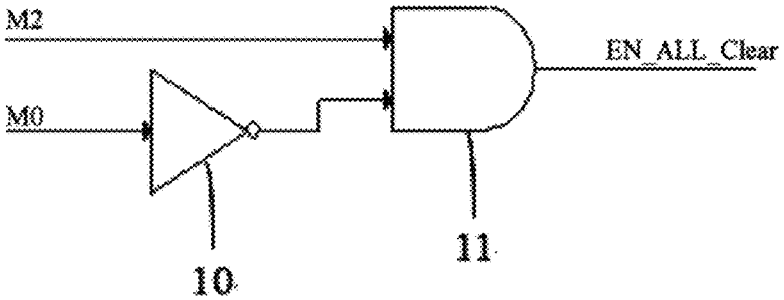
FIG. 7 illustrates a schematic structural diagram of a second logic circuit according to an exemplary embodiment of the present disclosure.

In addition, it also may be determined whether it is in the all-clear mode by using a second logic circuit as shown in FIG. 7, and then a corresponding display mode signal is outputted. The second logic circuit is composed of one inverter 10 and one AND gate 11. Specifically, when the display mode state mode is the all-clear mode, the display mode signal outputted by the second logic circuit is referred to as a fifth state mode signal EN_ALL_Clear:

$$EN_ALL_Clear=M2*/M0.$$

When the color display state mode is a first color display state mode, the outputted display mode signal is referred to as a first color mode signal EN_Data_3 Bit:

$$EN_Data_3\ Bit=M0*/M2*/M3*/M4=M0*/(M2+M3)*/M4.$$

When the color display state mode is the black-and-white display state mode, the outputted display mode signal is referred to as a second color mode signal EN_Data_1 Bit:

$$EN_Data_1\ Bit=M0*/M2*/M3*M4=M0*/(M2+M3)*M4.$$

Figure 8:
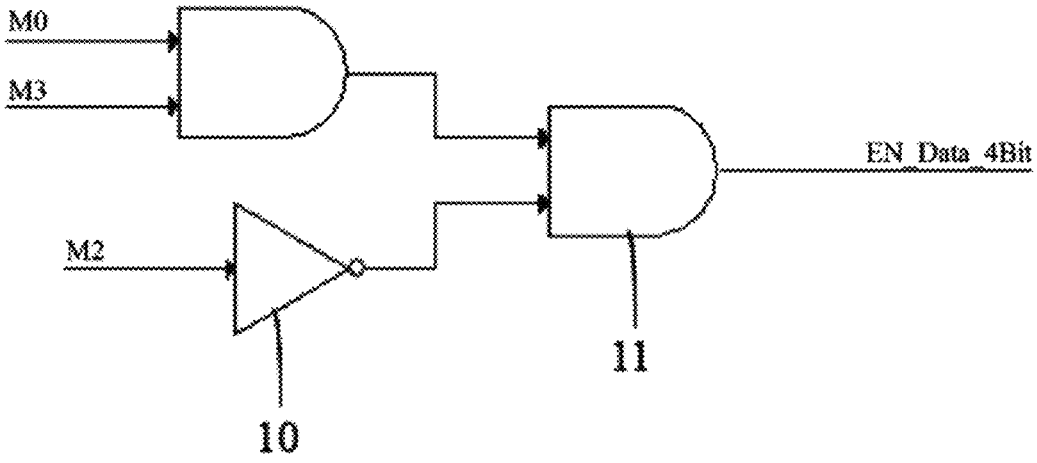
FIG. 8 illustrates a schematic structural diagram of a third logic circuit according to an exemplary embodiment of the present disclosure.

In addition, it also may be determined whether it is the second color display state mode by using a third logic circuit as shown in FIG. 8, and then a corresponding display mode signal is outputted. The third logic circuit is composed of one inverter 10 and two AND gates 11. Specifically, when the color display state mode is the second color display state mode, the display mode signal outputted by the third logic circuit is referred to as a third color mode signal EN_Data_4 Bit:

$$EN_Data_4\ Bit=M0*/M2*M3.$$

In the logic circuits as shown in FIG. 6 to FIG. 8, each data bit of the display mode is inputted to the input terminal thereof, and a corresponding display mode signal may be outputted through the output terminal thereof. The display mode signal may include the first state mode signal, the second state mode signal, the third state mode signal, the fourth state mode signal, the first color mode signal, the second color mode signal, and the third color mode signal. The obtained display mode signals may be provided to the driving circuit in the display apparatus, such that the display apparatus correspondingly displays according to the display modes. The related circuits include, for example, a pixel driving circuit, a counter, a data latch, a flip-flop, or the like.

For example, the outputted first state mode signal is supplied to the counter and the data latch, the counter stops counting when receiving the first state mode signal, and the data latch stops outputting the latched data when receiving the first state mode signal.

The outputted second state mode signal is supplied to the flip-flop, the data latch and the gate driving circuit. The flip-flop is set to be 0 when the second state mode signal is received, and the data latch is set to be 0 when the second state mode signal is received. The gate driving circuit stops outputting the gate line scanning signal when the second state mode signal is received, and all the thin film transistors in the display apparatus are in an on state.

The outputted third state mode signal or the fourth state mode signal is provided to the pixel driving circuit, such that the pixel driving circuit controls display blinking.

When it is determined by the logic circuit that the display mode is the white display mode, the corresponding signal generated is provided to the related circuit, such that the data voltage of each pixel unit is the voltage required to display white.

When it is determined by the logic circuit that the display mode is the black display mode, the corresponding display mode signal generated is provided to the related circuit, such that the data voltage of each pixel unit is the voltage required to display black.

The above only enumerates several methods for determining the display modes by way of the display mode data bits to obtain the display mode signal. Furthermore, the display apparatus may also adopt other display modes or use other methods and determination circuits having other structures to implement the above-mentioned effects, which are not limited by the present disclosure.

For the method of obtaining the gate line scanning signal by decoding the gate line scanning data bit, for example, supposing the display apparatus includes 176 gate lines, the gate line scanning data bit only needs 8 bit data, scanning signals can be provided to 256 gate lines, and the requirements of 176 gate lines are satisfied. If the gate line scanning data bit includes 10 bit data, only eight data bits are needed to be valid.

For example, the 176 gate lines are respectively G1, G2, G3, G4, . . . , and G176, and the eight valid data bits in the gate line scanning data bits are A0, A1, A2, A3, A4, A5, A6, and A7, respectively. The scanning signals of the 176 gate lines may be obtained by decoding by a gate line decoder composed of a plurality of 4 bit address decoders.

Figure 9:
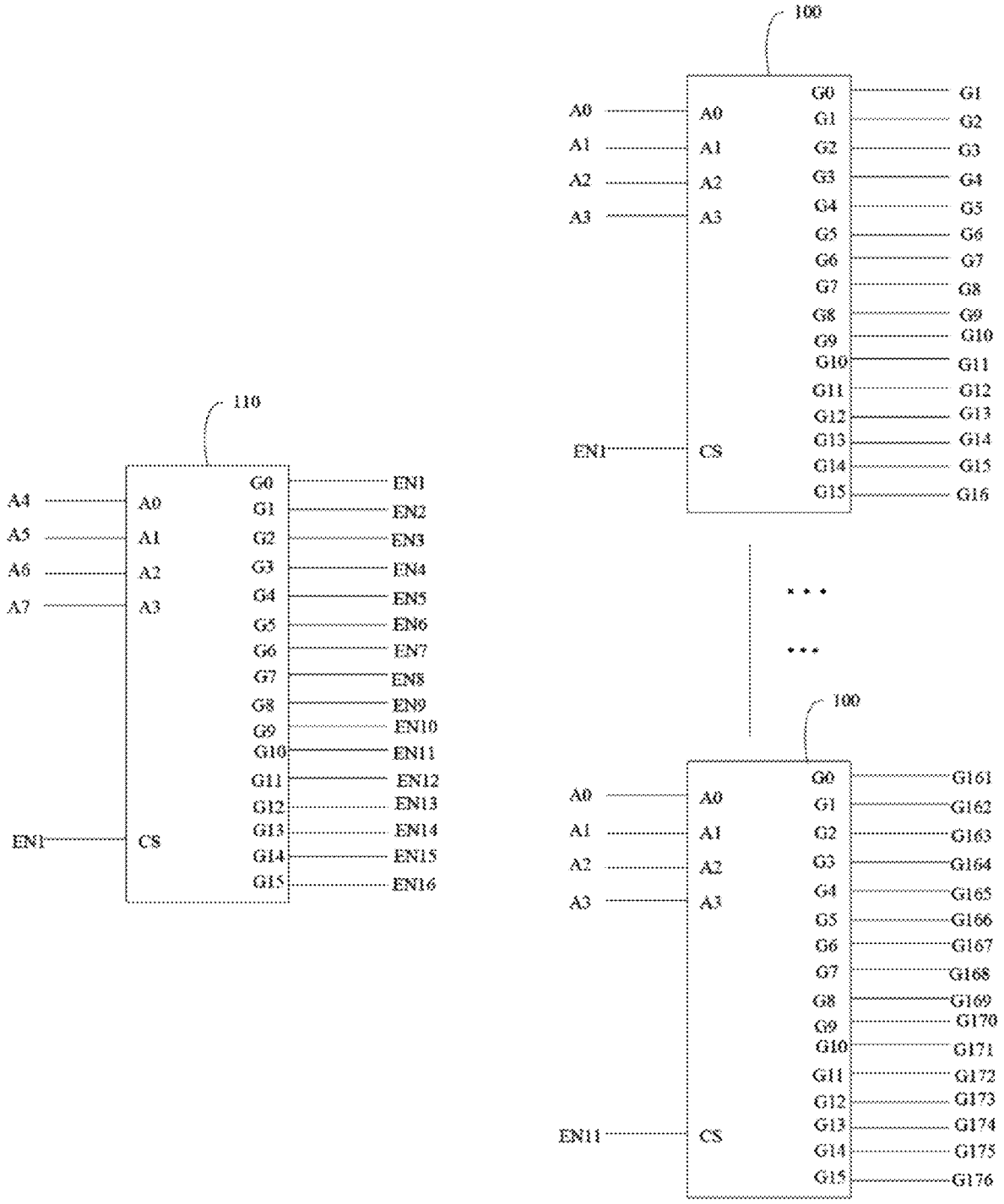
FIG. 9 illustrates a schematic structural diagram of a gate line decoder according to an exemplary embodiment of the present disclosure.

As shown in FIG. 9, for the scanning signals of the 176 gate lines, the gate line decoder includes eleven 4 bit first address decoders 100 and one second address decoder 110. Four valid data bits A0-A3 among the gate line scanning data bits may be correspondingly inputted to four input interfaces A0-A3 of each of the first address decoders 100. After decoding, each of the first address decoders 100 outputs the scanning signals of 16 gate lines through output interface G0-G15. After being decoded by each of the first address decoders, the scanning signals of the 176 gate lines may be obtained.

Moreover, for each of the first address decoders 100, the input signal further includes a clock signal CS. To obtain the clock signal for each of the first address decoders 100, a second address decoder 110 may be additionally provided. The four valid data bits A4-A5 of the gate line scanning data bits are respectively inputted to the input interfaces A0-A3 of the second address decoder 110. After decoding, 16 clock signals EN1, EN2, EN3, . . . , and EN16 are obtained. From the above 16 clock signals, 11 clock signals, such as EN1-EN11, may be selected to serve as the clock signals CS of the above eleven first address decoders, respectively. The scanning signals outputted from the 16 output interfaces G0-G15 of each of the first address decoders respectively are:

$$G0 = /A7^*/A6^*/A5^*/A4^*/A3^*/A2^*/A1^*/A0;$$

$$G1 = /A7^*/A6^*/A5^*/A4^*/A3^*/A2^*/A1^*A0;$$

$$G2 = /A7^*/A6^*/A5^*/A4^*/A3^*/A2^*A1^*/A0;$$

$$\ldots\ \ldots\ \ldots;$$

$$G175 = A7^*/A6^*A5^*/A4^*A3^*A2^*A1^*A0.$$

After decoding by the gate line decoder, the required gate line scanning signals may be obtained, wherein the gate line scanning signals include the scanning signals G1-G175 of the 176 gate lines.

In an optional embodiment, the Step S30 of shifting the initial data voltage signal according to the display mode signal to obtain a data voltage signal includes:

Step S31: shifting the initial data voltage signal according to the number of bits of the data voltage in the display mode signal to obtain the data voltage signal.

After the initial data voltage signal is obtained to acquire the data voltage signal inputted to each data line, the initial data voltage signal needs to be shifted. During shifting, the initial data voltage signal needs to be shifted according to the number of bits of the data voltage in the display mode signal. The number of bits of the data voltage refers to the number of data bits included in the data voltage of the display apparatus. For example, for displaying a color frame, the number of bits of the data voltage may be 3 bit or 4 bit. For displaying black and white frames, the number of bits of the data voltage may be 1 bit. Different shifting methods may be adopted for different numbers of bits of the data voltage.

Figure 10:
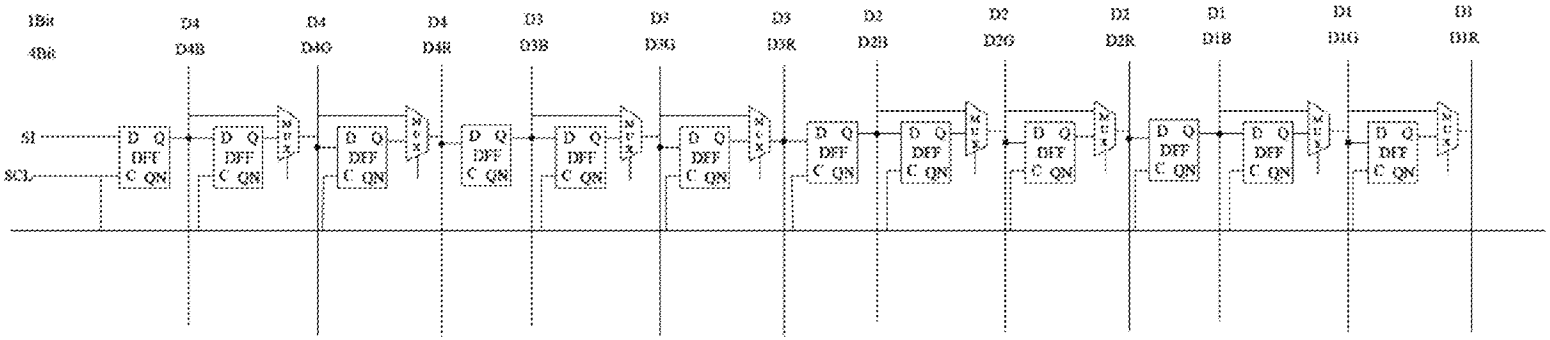
FIG. 10 illustrates a schematic structural diagram of a first shift register according to an exemplary embodiment of the present disclosure.

When the data voltage signal is inputted to each column of data lines, generally, the data voltage signal is shifted by a shift register, and data are latched by a data latch and then are inputted to each column of data lines. If the initial data voltage signal includes 12 bit data, a 12 bit shift register may be used, which is referred to as a first shift register herein. Referring to FIG. 10, the first shift register includes 12 cascaded flip-flops DFF. Output of the previous-stage flip-flop DFF serves as input of the latter-stage flip-flop DFF. The initial data voltage signal SI is inputted to an input terminal D of the first-stage flip-flop DFF, and the clock input signal SCL is coupled to a clock input terminal C of the flip-flop DFF.

The method of shifting the initial data voltage signal using the first shift register according to the number of bits of the data voltage in the display mode signal specifically is as follows.

When the number of bits of the data voltage is 3 bit, the first shift register normally shifts the 12 bit data in the initial data voltage signal, and the data latch is enabled once every 12 pulses in the clock input signal are outputted. The data voltage signal is outputted once each time the data latch is enabled. The data voltage signal outputted each time includes 12 data bits, and each data bit represents a pixel voltage of a sub-pixel unit. In this regard, by sequentially outputting the data voltage signals, data voltage input to all data lines is completed to charge each sub-pixel unit.

When the number of bits of the data voltage is 1 bit, three sub-pixel units in each pixel unit have a data voltage of only one color. At this moment, as shown in FIG. 10, a plurality of data selectors MUX are further arranged in the first shift register to control one flip-flop DFF to be enabled every other two flip-flops DFF in the first shift register. That is, two flip-flops DFF among three consecutive flip-flops DFF are skipped. The data latch is enabled once every 4 pulses in the clock input signal are outputted. The data voltage signal is outputted once each time the data latch is enabled. The data voltage signal outputted each time includes 3 data bits, and each data bit represents a data voltage, which may serve as the data voltage of the three sub-pixel units in one pixel unit. In this regard, by sequentially outputting the data voltage signals, data voltage input to all data lines is completed to charge each sub-pixel unit.

Figure 11:
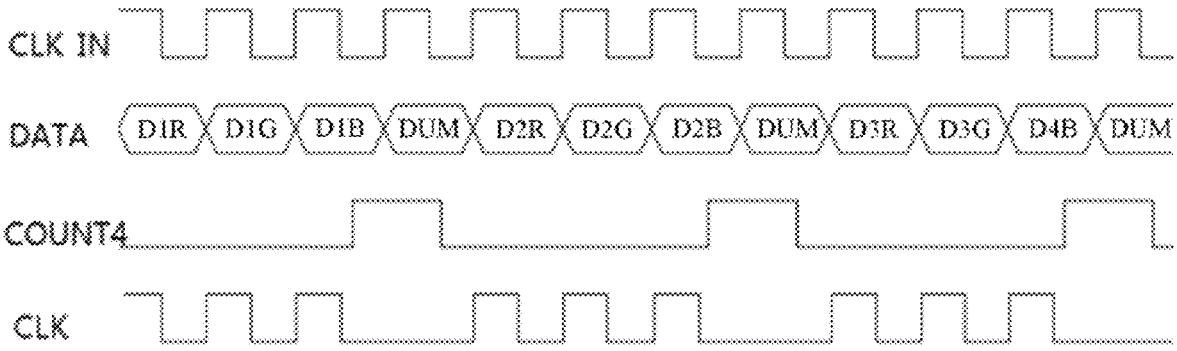
FIG. 11 illustrates a timing diagram of each signal according to an exemplary embodiment of the present disclosure.

When the number of bits of the data voltage is 4 bit, wherein a 1 bit data bit is a redundant data bit, and the clock input signal CLK IN can be converted. As shown in FIG. 11, each set of data voltage signals SI includes 12 bit data (DATE), i.e., including 12 data bits: D1R, D1G, D1B, DUM, D2R, D2G, D2B, DUM, D3R, D3G, D3B, and DUM respectively, wherein the DUM represents an invalid data bit. The number of pulses of a clock input signal CLK IN inputted may be counted based on a signal COUNT4 outputted by a counter. The clock input signal CLK IN is converted, and another clock signal CLK may be obtained by converting every four pulses in the clock input signal CLK IN into three pulses. That is, the data latch is enabled once by every 16 pulses in the original clock input signal CLK IN, and one invalid data bit DUM in the 4 bit data may be skipped, such that only 3 bit data in the 4 bit data are taken. Thus, similar to the case where the number of bits of the data voltage is 3 bit, the data voltage signal outputted each time includes 12 data bits, wherein each data bit represents a data voltage of one sub-pixel unit. In this regard, by sequentially outputting the data voltage signals, data voltage input to all data lines is completed to charge each sub-pixel unit.

The outputted data voltage signal after being shifted by the first shift register may be referred to FIG. 10. When the number of bits of the data voltage is 1 bit, the pixel voltages of three sub-pixel units in each pixel unit are equal. For example, the data voltages of the three sub-pixel units in the fourth column are all D4, the data voltages of the three sub-pixel units in the third column are all D3, the data voltages of the three sub-pixel units in the second column are all D2, and the data voltages of the three sub-pixel units in the first column are all D1. When the number of bits of the data voltage is 3 bit or 4 bit, the data voltages of the three sub-pixel units in each pixel unit are different. For example, the data voltages of the three sub-pixel units in the fourth column are D4B, D4G, and D4R respectively, the data voltages of the three sub-pixel units in the third column are D3B, D3G, and D3R respectively, the data voltages of the three sub-pixel units in the second column are D2B, D2G, and D2R respectively, and the data voltages of the three sub-pixel units in the first column are D1B, D1G, and D1R respectively.

When the original display data signal is sampled, it is required to count the number of pulses in the clock input signal to obtain the display mode data bit, the gate line scanning data bit, and the data voltage data bit. Taking an example where the display mode data bit includes 6 bit data, the gate line scanning data bit includes 10 bit data, and the data voltage data bit includes 12 bit data, as described above, for the obtained display mode data bit, the first number of counting the pulses is 6. For the obtained gate line scanning data bit, the second number of counting the pulses (which may be consecutive to counting of the display mode data bit) is 16. For the obtained data voltage data bit, the third number of counting the pulses may be 12, 8, 4, etc.

For the counting of the display mode data bits and the counting of the gate line scanning data bits, it is only required to determine the display mode for each frame once. The display mode data bits may be counted using a counter at the beginning of each frame, then the counter is reset. Then, the gate line scanning data bits are counted using the counter again based on the gate line scanning signal within the time of each frame. Therefore, the counting of the display mode data bits and the counting of the gate line scanning data bits do not affect each other and can be carried out simultaneously. However, the counting of the data voltage data bits may be carried out asynchronously with respect to the counting of the display mode data bits and the counting of the gate line scanning data bits. For example, the counting of the data voltage data bits may be carried out after the counting of the display mode data bits and the counting of the gate line scanning data bits are completed. Therefore, the counters used to obtain the first number, the second number and the third number may be the same counter.

Figure 12:
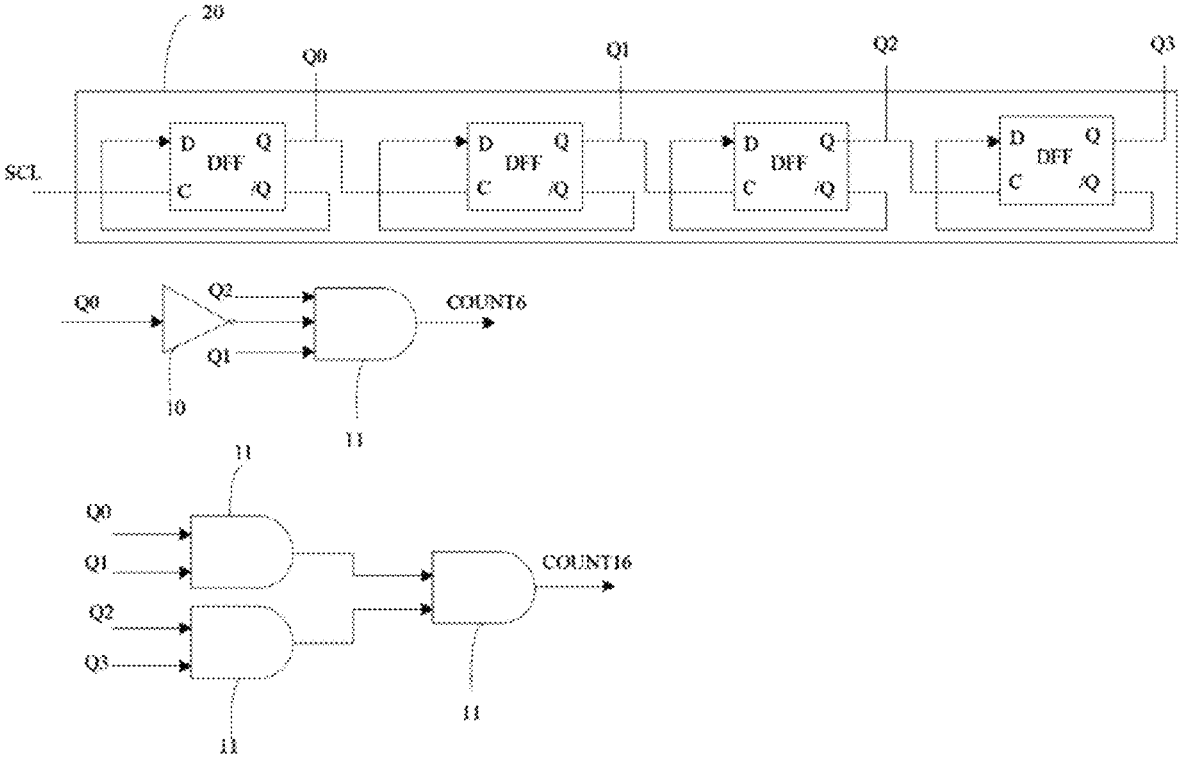
FIG. 12 illustrates a schematic structural diagram of a first counter according to an exemplary embodiment of the present disclosure.

The counters used to obtain the first number and the second number may be the same counter, which is referred to as a first counter. The structure of the first counter is, for example, as shown in FIG. 12. Specifically, the first counter may include a 4 bit shift register, which is referred to as a second shift register 20 herein. Furthermore, the first counter may also include a fourth logic circuit composed of one inverter 10 and four AND gates 10. The clock signal of the second shift register 20 may be the clock input signal SCL described above. The outputs Q0, Q1, Q2, and Q3 of the second shift register may respectively serve as inputs of the fourth logic circuit. The first number 6 and the second number 16 may be obtained by counting using the first counter. After counting, the signals outputted by the fourth logic circuit are COUNT6 and COUNT16, and the output signals may be further outputted to the relevant circuit.

Figure 13:
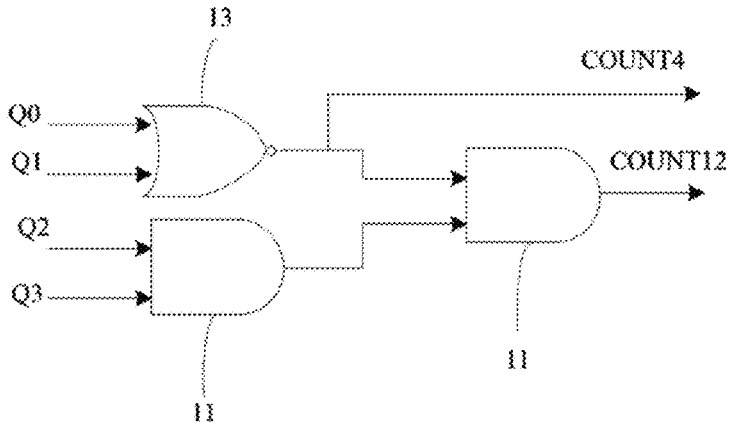
FIG. 13 illustrates a schematic structural diagram of a fifth logic circuit according to an exemplary embodiment of the present disclosure.

The counter used to obtain the third number may also adopt the first counter. To obtain the third number by the first counter, the first counter may further include a fifth logic circuit as shown in FIG. 13. The fifth logic circuit is a logic circuit composed of one NOR gate 13 and two AND gates 11, and the outputs Q0, Q1, Q2, and Q3 of the second shift register 20 may respectively serve as input of the fifth logic circuit, and then the third number (4 or 12) may be obtained by the first counter. After counting, signals outputted by the fifth logic circuit are signals COUNT4 and COUNT12.

Figure 14:
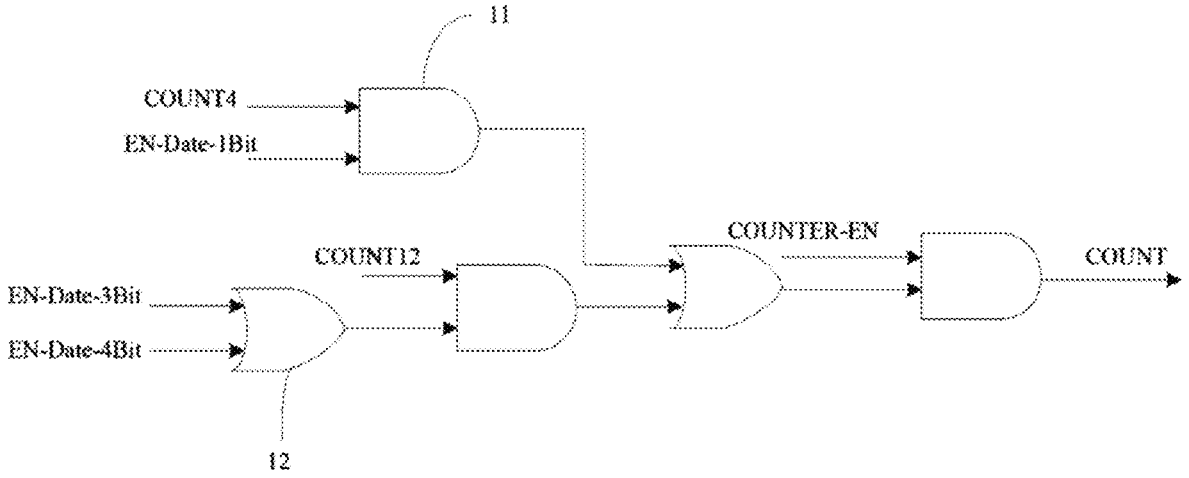
FIG. 14 illustrates a schematic structural diagram of a sixth logic circuit according to an exemplary embodiment of the present disclosure.

Further, the first counter may also include a sixth logic circuit, which is, for example, as shown in FIG. 14. The sixth logic circuit includes, for example, three AND gates 11 and two OR gates 12. The above output signals COUNT4 and COUNT12, a counting start signal COUNTER-EN, and the display mode signal such as a first color mode signal EN_Data_3 Bit, a second color mode signal EN_Data_1 Bit and a third color mode signal EN_Data_4 Bit may serve as input signals of the sixth logic circuit. The final output signal COUNT may be obtained after an operation carried out by the sixth logic circuit.

The above output signal obtained by counting by the first counter may be outputted to an associated circuit, thereby obtaining the display mode signal, the gate line scanning signal, and the initial data voltage signal from original data signal sampling.

It is to be noted that the above first counter employed to obtain the first number, the second number, and the third number may be an integrated counter. The counter may complete counting of the first number, the second number, and the third number. The counter includes, for example, circuits as shown in FIG. 12-FIG. 14. Optionally, the first counter may include a plurality of separate counters. The specific structure of the first counter is not limited to the structure described in the above embodiments, and other circuit structures may be used, and the present disclosure is not limited thereto.

In an optional embodiment, the method may further include:

Step S50: latching the data voltage signal received with a latch, and writing the latched data voltage signal into a pixel unit after the gate line scanning signal of a current row is received;

Step S51: outputting the gate line scanning signal of a next row after writing the data voltage signal is completed;

Step S52: starting to count using a second counter when latching the data voltage signal, and stopping counting after writing the data voltage signal is completed; and Step S53: controlling the first counter not to output a signal when the second counter is not zero, and resetting the first counter when the second counter stops counting.

For writing the data voltage to a pixel unit through a data line, as generally a larger number of column data lines are included, after the data voltage signal is received, the data voltage signal may be first latched by the data latch. That is, data in the data voltage signal are latched. After the gate line scanning signal of the current row is received, the latched data voltage signal begins being outputted, and the data voltage signal is written into the pixel unit. For example, if 44*12 columns of data lines are included, the data voltage signal is shifted using a 12 bit shift register, and the 12 bit data are latched once. After the gate line scanning signal of the current row is received, i.e., after the thin film transistors in the current row of gate lines are enabled, the data voltage signals represented by the 12 bit data may be sequentially outputted, and then may be written into the pixel unit through the data lines. After the data voltage signals of each column of data lines are written, the thin film transistors in another row of gate lines are enabled, that is, scanning of a next row of gate lines is not started unless the data voltage signals are written each time. Therefore, 44 latches need to be performed, and the data latch is enabled 44 times. In this way, the scanning of all the gate lines and the output of the data voltage signals of all the data lines may be completed, that is, charging all the pixel units in one frame of display screen is completed.

Each time when the data voltage signals are latched, it is required to count the data voltage signals using a second counter, so as to learn whether the data voltage signals are latched each time. The second counter starts counting when the data voltage is latched, and the second counter stops counting after writing the data voltage signals is completed. The counting of the second counter may reach a certain number threshold when stopping counting. At this moment, one time of latching counting of the data voltage signals is completed, then the data voltage signals are latched for a next time, the first counter is reset.

Figure 15:
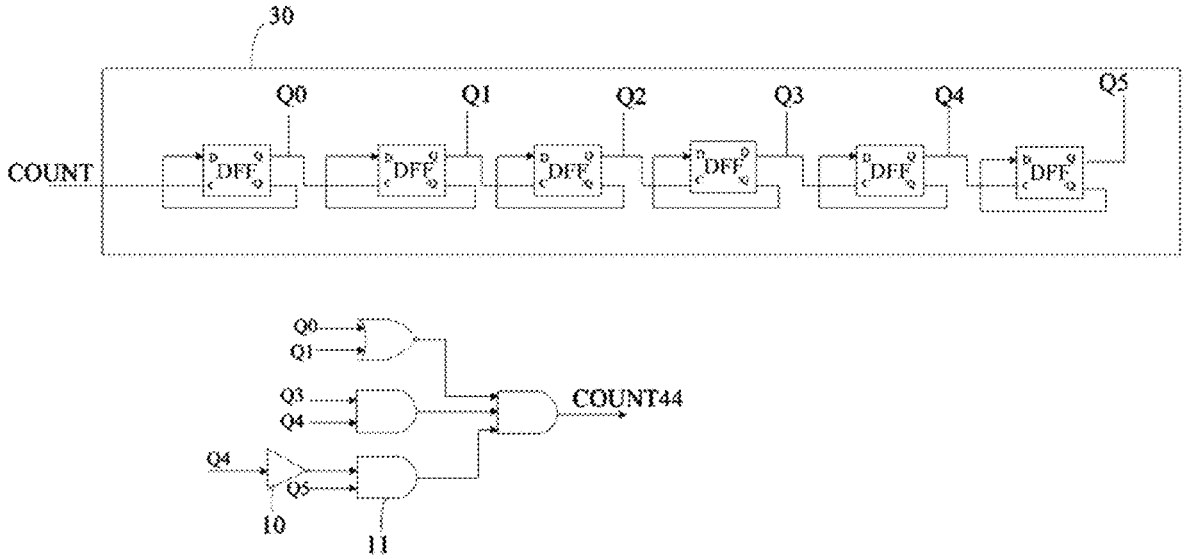
FIG. 15 illustrates a schematic structural diagram of a second counter according to an exemplary embodiment of the present disclosure.

The second counter may be another counter, and the second counter is configured to count latches of the data voltage signals. The structure of the second counter may be, for example, as shown in FIG. 15, including a 6 bit shift register, which is referred to as a third shift register 30 herein. Furthermore, the second counter also includes a seventh logic circuit composed of one inverter 10, three AND gates 11 and one NOR gate 13. Outputs Q0, Q1, Q2, Q3, Q4, and Q5 of the third shift register 30 may respectively serve as input of the seventh logic circuit. The output signal COUNT of the first counter may serve as a clock signal of the second counter. When the second counter counts to 44, the result Y of counting by the second counter each time is as below: Y=/Q5*/Q4*/Q3*/Q2*/Q1*/Q0. Specifically, the 44 counting results of the second counter are Y0-Y43, respectively. Accordingly, the second counter counts up to 44, resets and then resets to recount:

$$Y0 = /Q5^*/Q4^*/Q3^*/Q2^*/Q1^*Q0;$$

$$Y1 = /Q5^*/Q4^*/Q3^*/Q2^*Q1^*/Q0;$$

$$\cdots\cdots$$

$$Y43 = Q5^*/Q4^*Q3^*Q2^*/Q1^*/Q0.$$

The output signal COUNT44 outputted by the second counter after counting may be outputted to the first counter, and the first counter may operate accordingly. For example, when the second counter is not zero, the first counter neither operates nor outputs any signal. When the number of counts of the second counter reaches the number threshold, i.e., when the second counter stops counting, for example, when the number of counts is 44, this indicates that one time of writing the data voltage signals is completed. At this moment, the first counter is reset, and writing the data voltage signals is started for the next time.

Figure 16:
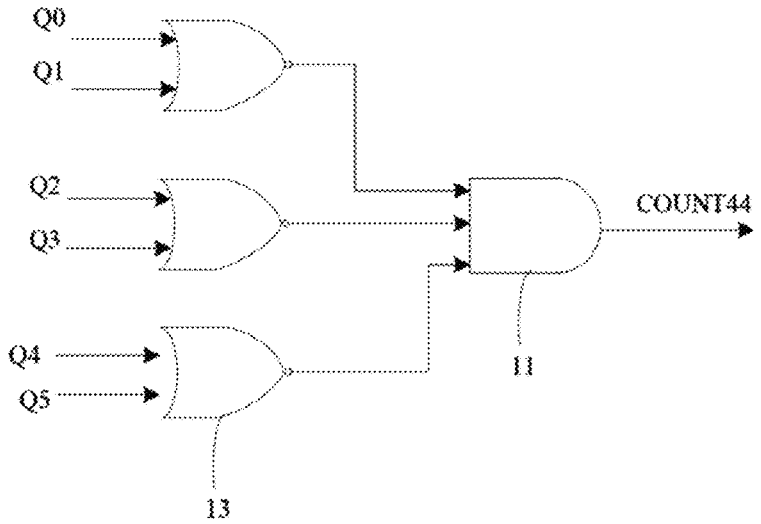
FIG. 16 illustrates a schematic structural diagram of a seventh logic circuit according to an exemplary embodiment of the present disclosure.

The seventh logic circuit may have another structure, for example, the structure as shown in FIG. 16. The seventh logic circuit is a circuit composed of three NOR gates 13 and one AND gate 11. The second counter of another structure may be formed by the logic circuit of this structure and the above third shift register. Of course, the second counter may also adopt other circuit structures, which is not limited by the present disclosure.

Figure 17:
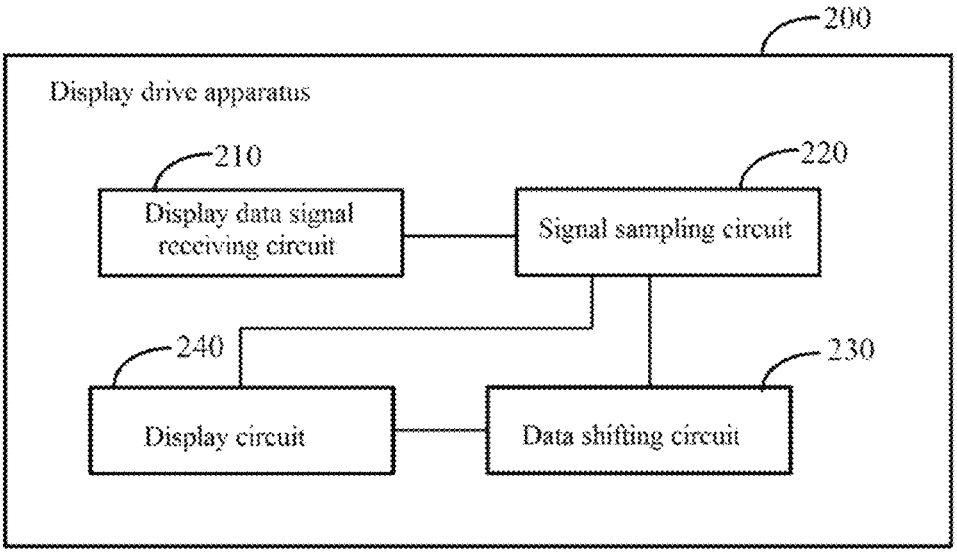
FIG. 17 illustrates a block diagram of a display drive apparatus according to an exemplary embodiment of the present disclosure.

The embodiments of the present disclosure further provide a display drive apparatus, which is used in a display apparatus. As shown in FIG. 17, the display drive apparatus 200 includes:

a display data signal receiving circuit 210, configured to receive an original display data signal;

a signal sampling circuit 220, configured to sample the original display data signal based on a clock input signal to obtain a display mode signal, a gate line scanning signal, and an initial data voltage signal;

a data shifting circuit 230, configured to shift the initial data voltage signal according to the display mode signal to obtain a data voltage signal; and a display circuit 240, configured to control the display apparatus to display based on the display mode signal, the gate line scanning signal and the data voltage signal.

Figure 18:
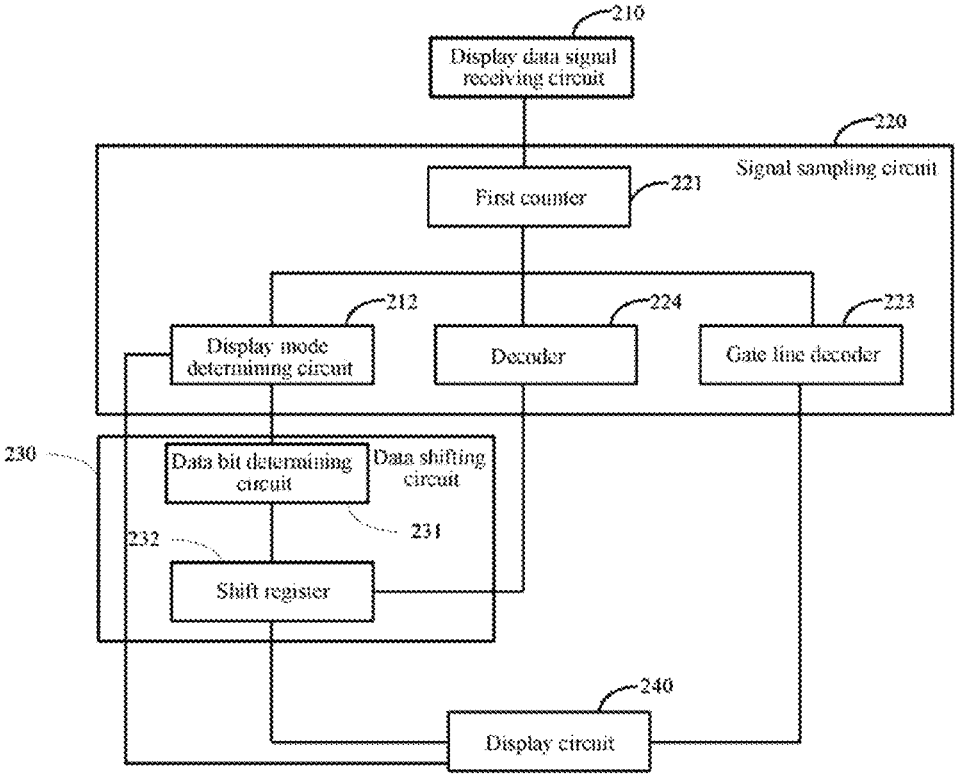
FIG. 18 illustrates a block diagram of a display drive apparatus according to another exemplary embodiment of the present disclosure.

In some examples, as shown in FIG. 18, the signal sampling circuit 220 includes:

a first counter 221, configured to count the number of pulses in the clock input signal, and acquire a display mode data bit, a gate line scanning data bit and a data voltage data bit from the original display data signal respectively according to the number of pulses counted;

a display mode determining circuit 222, configured to obtain the display mode signal based on the display mode data bit;

an address decoder 223, configured to decode the gate line scanning data bit to obtain the gate line scanning signal; and a decoder 224, configured to obtain the initial data voltage signal according to the data voltage data bit.

In an optional embodiment, the data shifting circuit 230 includes:

a data bit determining circuit 231, configured to determine the number of bits of a data voltage in the display mode signal; and a shift register 232, configured to shift the initial data voltage signal according to the number of bits of the data voltage to obtain the data voltage signal.

Figure 19:
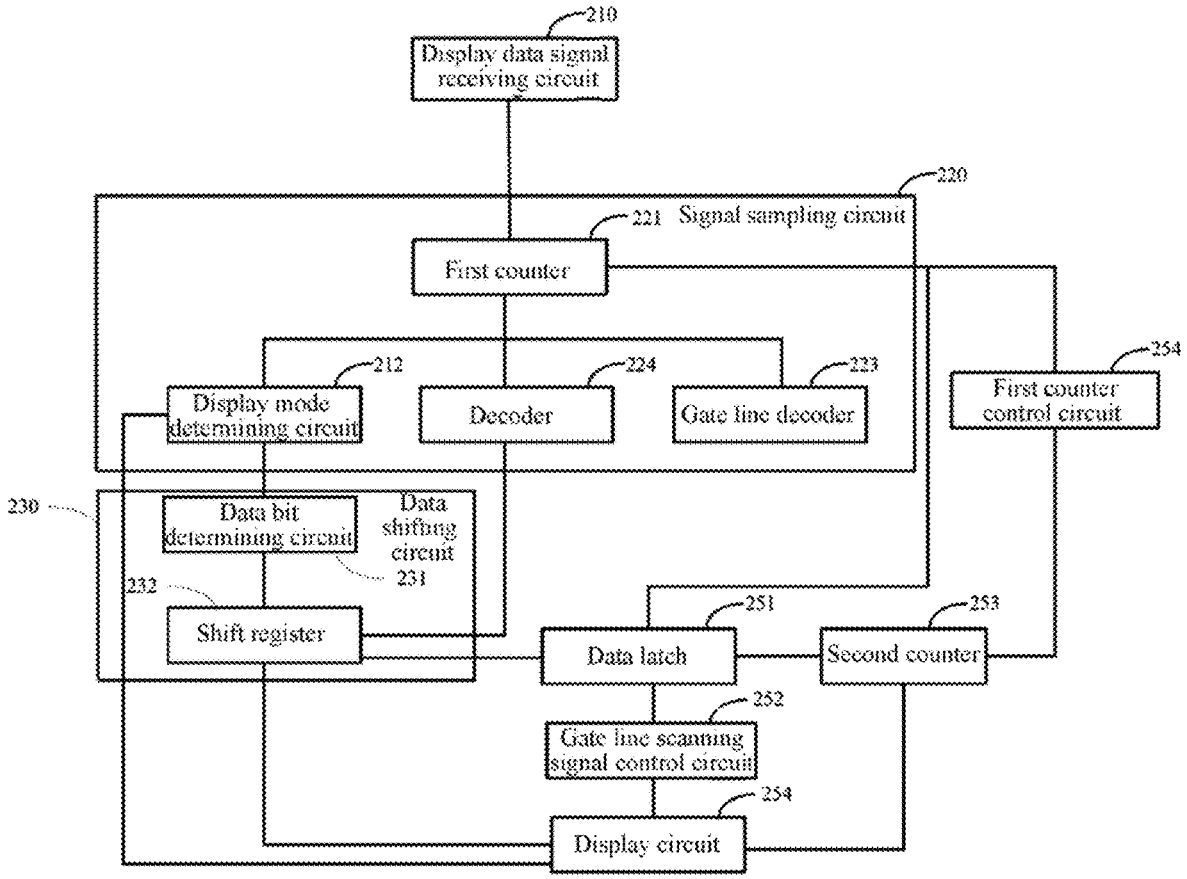
FIG. 19 illustrates a block diagram of a display drive apparatus according to still another exemplary embodiment of the present disclosure.

In an optional embodiment, as shown in FIG. 19, the display drive apparatus further includes:

a data latch 251, configured to latch the data voltage signal after the data voltage signal is received, and write the latched data voltage signal into a pixel unit of the display apparatus after the gate line scanning signal of a current row is received;

a gate line scanning signal control circuit 252, configured to output the gate line scanning signal of a next row after writing the data voltage signal is completed;

a second counter 253, configured to start to count when latching the data voltage signal, and stop counting after writing the data voltage signal is completed; and a first counter second control circuit 254, configured to control the first counter not to output a signal when the second counter is not zero, and reset the first counter when the second counter stops counting.

As for implementations of functions and roles of units or components in the above apparatus embodiments, please refer to the implementations of corresponding steps in the above method for details, and thus their detailed descriptions are not repeated herein.

The above units may be implemented by hardware. For example, the display data signal receiving circuit may be an associated data interface, such as a serial peripheral interface (SPI). The signal sampling circuit may be a sampling circuit. The first counter and the second counter may be implemented by the above-mentioned circuits or other related circuits. The display mode determining circuit may use, for example, the first logic circuit, the second logic circuit, and the third logic circuit, or may use circuits having other structures. The data bit determining circuit, the first control circuit of the counter, and the second control circuit of the counter may be implemented by using a microchip or a related circuit. The gate line decoder may be implemented by using a circuit structure composed of the first address decoder and the second address decoder described above. The decoder may be a decoder in the prior art. The shift register may be implemented, for example, using the first shift register described above or hardware circuits having other structures.

The display drive apparatus of the above embodiments may generate corresponding signals according to different types of display apparatuses. The display drive apparatus is applicable to different types of display apparatuses, and is particularly applicable to wearable products. Therefore, this display drive method is universal, which is advantageous in reducing product development cycles and development costs.

The embodiments of the present disclosure further provide a display apparatus, which includes a display panel and the display drive apparatus according to any one of the above embodiments, wherein the display drive apparatus is arranged on the display panel.

In the display apparatus, the display drive apparatus is arranged on the display panel. For example, related circuits of the display drive apparatus are directly formed on an array substrate of the display panel. The display drive apparatus may generate a drive signal required for displaying to scan a gate line and shift a data voltage of a data line, etc. It is unnecessary to arrange an additional drive chip. The display drive apparatus is applicable to different types of display apparatuses, and is particularly applicable to wearable products. Therefore, this display drive method has certain universality, which is advantageous to reducing product development cycles and development costs.

The embodiments of the present disclosure further provide a wearable device, which includes the above display apparatus.

The wearable device adopts the above display apparatus, and it is unnecessary to provide an additional drive chip to the wearable device, which is advantageous to reducing product development cycles and development costs.

The above wearable device may be, for example, a smart watch, a smart wristband, virtual reality glasses, and so on, which may be directly worn on a human body.

Other embodiments of the present disclosure will be apparent to those skilled in the art from consideration of the specification and practice of the present disclosure disclosed here. The present disclosure is intended to cover any variations, uses, or adaptations of the present disclosure following the general principles thereof and including such departures from the present disclosure as come within known or customary practice in the art. It is intended that the specification and embodiments be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A display drive method used in a display apparatus, the method comprising:

receiving an original display data signal comprising a display mode data bit, a gate line scanning data bit and a data voltage data bit;

sampling the original display data signal based on a clock input signal to obtain a display mode signal, a gate line scanning signal, and an initial data voltage signal, respectively, based on the display mode data bit, the gate line scanning data bit and the data voltage data bit of the original display data signal by:

counting a number of pulses in the clock input signal, and acquiring the display mode data bit, the gate line scanning data bit, and the data voltage data bit from the original display data signal respectively according to the number of pulses counted;

obtaining the display mode signal based on the display mode data bit by determining a current display state mode and a color display state mode for the display apparatus based on a value of each data bit of the display mode data bit, and generating a corresponding display mode signal according to the current display state mode and the color display state mode; and decoding the gate line scanning data bit to obtain the gate line scanning signal; and obtaining the initial data voltage signal according to the data voltage data bit;

shifting the initial data voltage signal according to the display mode signal to obtain a data voltage signal; and controlling the display apparatus to display based on the display mode signal, the gate line scanning signal, and the data voltage signal.

2. The method according to claim 1, wherein the shifting the initial data voltage signal according to the display mode signal to obtain a data voltage signal comprises:

shifting the initial data voltage signal according to the number of bits of a data voltage in the display mode signal to obtain the data voltage signal.

3. The method according to claim 1, wherein:

the display state mode comprises one of: a no update mode, an all-clear mode, a normal display mode, and a display blinking mode; and the color display state mode comprises one of: a black-and-white display state mode and a colored display state mode.

4. The method according to claim 1, wherein the counting of the number of pulses in the clock input signal, and acquiring the display mode data bit, the gate line scanning data bit, and the data voltage data bit from the original display data signal respectively according to the number of pulses counted comprise:

counting the number of pulses in the clock input signal by using a first counter to obtain a first number, a second number, and a third number respectively;

acquiring the display mode data bit from the original display data signal according to the first number;

acquiring the gate line scanning data bit from the original display data signal according to the second number; and acquiring the data voltage data bit from the original display data signal according to the third number.

5. The method according to claim 4, further comprising:

latching the data voltage signal after the data voltage signal is received, and writing the latched data voltage signal into a pixel unit of the display apparatus after the gate line scanning signal of a current row is received;

outputting the gate line scanning signal of a next row after writing the data voltage signal is completed;

starting to count using a second counter when latching the data voltage signal, and stopping counting after writing the data voltage signal is completed; and controlling the first counter not to output a signal when the second counter is not zero, and resetting the first counter when the second counter stops counting.

6. A display drive apparatus, comprising:

a display data signal receiving circuit configured to receive an original display data signal comprising a display mode data bit, a gate line scanning data bit, and a data voltage data bit;

a signal sampling circuit configured to sample the original display data signal based on a clock input signal to obtain a display mode signal, a gate line scanning signal, and an initial data voltage signal, respectively, based on the display mode data bit, the gate line scanning data bit and the data voltage data bit of the original display data signal, wherein the signal sampling circuit comprises:

a first counter configured to count a number of pulses in the clock input signal, and acquire the display mode data bit, the gate line scanning data bit, and the data voltage data bit from the original display data signal respectively according to the number of pulses counted;

a display mode determining circuit configured to obtain the display mode signal based on the display mode data bit by determining a current display state mode and a color display state mode for the display apparatus based on a value of each data bit of the display mode data bit, and generating a corresponding display mode signal according to the current display state mode and the color display state mode;

a gate line decoder configured to decode the gate line scanning data bit to obtain the gate line scanning signal; and a decoder configured to obtain the initial data voltage signal according to the data voltage data bit;

a data shifting circuit configured to shift the initial data voltage signal according to the display mode signal to obtain a data voltage signal; and a display circuit configured to control the display apparatus to display based on the display mode signal, the gate line scanning signal, and the data voltage signal.

7. The apparatus according to claim 6, wherein the display data signal receiving circuit is a serial peripheral interface.

8. The apparatus according to claim 6, wherein the data shifting circuit comprises:

a data bit determining circuit configured to determine the number of bits of a data voltage in the display mode signal; and a shift register configured to shift the initial data voltage signal according to the number of bits of the data voltage to obtain the data voltage signal.

9. The apparatus according to claim 6, further comprising:

a data latch configured to latch the data voltage signal after the data voltage signal is received, and write the latched data voltage signal into a pixel unit of the display apparatus after the gate line scanning signal of a current row is received;

a gate line scanning signal control circuit, configured to output the gate line scanning signal of a next row after writing the data voltage signal is completed;

a second counter configured to start to count when latching the data voltage signal, and stop counting after writing the data voltage signal is completed; and a first counter control circuit configured to control the first counter not to output a signal when the second counter is not zero, and reset the first counter when the second counter stops counting.

10. A system, comprising:

a display apparatus comprising a display panel and a display drive apparatus, wherein the display drive apparatus is arranged on the display panel and comprises:

a display data signal receiving circuit configured to receive an original display data signal comprising a display mode data bit, a gate line scanning data bit and a data voltage data bit;

a signal sampling circuit configured to sample the original display data signal based on a clock input signal to obtain a display mode signal, a gate line scanning signal, and an initial data voltage signal, respectively, based on the display mode data bit, the gate line scanning data bit and the data voltage data bit of the original display data signal, wherein the signal sampling circuit comprises:

a first counter configured to count the number of pulses in the clock input signal, and acquire the display mode data bit, the gate line scanning data bit, and the data voltage data bit from the original display data signal respectively according to the number of pulses counted;

a display mode determining circuit configured to obtain the display mode signal based on the display mode data bit by determining a current display state mode and a color display state mode for the display apparatus based on a value of each data bit of the display mode data bit, and generating a corresponding display mode signal according to the current display state mode and the color display state mode;

a gate line decoder configured to decode the gate line scanning data bit to obtain the gate line scanning signal; and a decoder configured to obtain the initial data voltage signal according to the data voltage data bit;

a data shifting circuit configured to shift the initial data voltage signal according to the display mode signal to obtain a data voltage signal; and a display circuit configured to control the display apparatus to display based on the display mode signal, the gate line scanning signal, and the data voltage signal.

11. The system according to claim 10, wherein the display data signal receiving circuit is a serial peripheral interface.

12. The system according to claim 10, wherein the data shifting circuit comprises:

a data bit determining circuit configured to determine the number of bits of a data voltage in the display mode signal; and a shift register configured to shift the initial data voltage signal according to the number of bits of the data voltage to obtain the data voltage signal.

13. The system according to claim 10, wherein the display drive apparatus further comprises:

a data latch configured to latch the data voltage signal after the data voltage signal is received, and write the latched data voltage signal into a pixel unit of the display apparatus after the gate line scanning signal of a current row is received;

a gate line scanning signal control circuit configured to output the gate line scanning signal of a next row after writing the data voltage signal is completed;

a second counter configured to start to count when latching the data voltage signal, and stop counting after writing the data voltage signal is completed; and a first counter control circuit configured to control the first counter not to output a signal when the second counter is not zero, and reset the first counter when the second counter stops counting.

14. The system according to claim 10, further comprising a wearable device, the wearable device comprising the display apparatus.

* * * * *